US005103975A

United States Patent [19]

Liu

[11] Patent Number: 5,103,975

[45] Date of Patent: Apr. 14, 1992

[54] LUGGAGE WITH SHOULDER STRAP ASSEMBLY AND SHOULDER STRAP STORAGE POCKET

[75] Inventor: Shaumin Liu, Portsmouth, Va.

[73] Assignee: Samsonite Corporation, Denver, Colo.

[21] Appl. No.: 616,508

[22] Filed: Nov. 21, 1990

[51] Int. Cl.[5] ..... A45C 13/00; A45C 15/22

[52] U.S. Cl. ..... 206/279; 150/110; 190/115; 190/116

[58] Field of Search ..... 190/115, 116, 119, 122, 190/107; 206/287.1, 278, 279; 150/110; 224/205, 258

[56] References Cited

U.S. PATENT DOCUMENTS

| | | | |
|---|---|---|---|
| 1,930,043 | 10/1933 | Evens | 206/291 X |
| 1,979,978 | 11/1934 | Martin | 190/115 |
| 2,626,689 | 1/1953 | Davis et al. | 206/287.1 |
| 2,706,024 | 4/1955 | Kish, Jr. | 190/115 |
| 2,914,105 | 11/1959 | Kushynski et al. | 150/110 |
| 4,545,414 | 10/1985 | Baum | 190/115 X |
| 4,756,394 | 7/1988 | Cohen | 190/107 X |
| 4,852,778 | 8/1989 | Beiser et al. | 224/258 X |
| 4,887,700 | 12/1989 | Rice | 206/287.1 X |
| 4,961,522 | 10/1990 | Weber | 190/119 X |

FOREIGN PATENT DOCUMENTS

| | | | |
|---|---|---|---|
| 890958 | 3/1962 | United Kingdom | 190/119 |
| 2076646 | 12/1981 | United Kingdom | 190/122 |

*Primary Examiner*—Sue A. Weaver

*Attorney, Agent, or Firm*—Gregory W. O'Connor

[57] ABSTRACT

Conventional garment bags and other "carryon" type luggage cases include a carry handle and a shoulder strap attached to the upper surface of the uppermost portion of the luggage piece called the console. In order to prevent the shoulder strap from tangling in baggage handling equipment, the shoulder strap includes a pair of releasable attachment means called snap hooks which permit the user to remove the shoulder strap and carry the shoulder strap separately or in a pocket included in the outer panel of the luggage piece. The luggage piece shown includes a dedicated shoulder strap pocket which extends substantially the entire width of the luggage piece and includes a zippered closure through which a permanently attached shoulder strap can be deployed. The shoulder strap is attached into the inside of the shoulder pocket and is structurally attached to the body of the luggage piece. The shoulder strap can be folded and placed within the shoulder strap pocket and the zipper closure closed in order to stow the strap for checking or otherwise.

17 Claims, 1 Drawing Sheet

LUGGAGE WITH SHOULDER STRAP ASSEMBLY AND SHOULDER STRAP STORAGE POCKET

BACKGROUND OF THE INVENTION

Garment bags have become quite a popular method of transporting clothing while traveling. Garment bags are typically large flexible envelope-like luggage pieces with inner and outer fabric walls and perhaps with fabric gussets or extensions connecting the opposed edges of the front and back walls to give the garment bag extra packing ability. Because of the size of such garment bags and for convenience of the airline traveler, many garment bags become "checked" luggage. This usually requires that the shoulder strap, which is used to conveniently carry the garment bag in its folded or suitcase-like configuration, be removed from the outside of the garment bag before it can be checked. If the shoulder strap is not removed, it can very often become entangled in the baggage handling machinery. If this happens, the shoulder strap can be damaged or, depending on what breaks first, the garment bag itself can be harmed.

The usual approach to this shoulder strap problem is to make the shoulder straps very easily removable, for example by the use of metal buckles, snaps, etc. However, buckles and the like increase the weight as well as the possibility that the shoulder strap assembly will become detached and lost, or will fail, either as checked baggage or while being carried.

OBJECTS OF THE INVENTION

It is one object of the invention to provide a garment bag or other luggage case with a shoulder strap system which is dependable while being used and may be dependently and easily stored when not used.

It is another object of the invention to provide a garment bag or other carried luggage with a shoulder strap assembly which is difficult to lose or separate from the garment bag, yet can be safely stowed to help prevent damage in airport baggage handling equipment (carousels, baggage trucks, etc.).

SUMMARY OF THE INVENTION

Accordingly, a hand luggage case is provided, such as a suitcase, garment bag, or the like, which has an outer wall and a handle console extending across this case at its uppermost end to which a carry handle is attached. The case further includes a shoulder strap for suspending the case from the shoulder of the user for convenient carrying. This case has an improvement comprising an elongated envelope for containing the shoulder strap. The elongated envelope is attached to the outer wall of the case close to the console. This envelope has a first end and a second end, a means inside the envelope for attaching the shoulder strap to the case, and a selectively openable closure such as a zipper extending between the first and second ends of the envelope. The shoulder strap is normally contained within the envelope and fastened to the case. Thus, when the shoulder strap is deployed from the envelope via the closure or zipper, the shoulder strap can be used to support the case. Preferably the zipper-type closure extends along the side of the envelope parallel and closest to the console.

Preferably the envelope comprises a first web of flexible fabric material fastened to a first surface of the outer wall. This web extends approximately the same length of the console and parallel to the console. The console includes a batten fastened on a second surface of the outer wall. The envelope and batten are proximate to one another. A length of fabric material preferably an extension of the woven webbing which comprises most of the shoulder strap itself or, alternatively, a loop of fabric material, such as a woven webbing, extends from the batten to the inside surface of the envelope. There are means for connecting this fabric loop to the shoulder strap. This means preferably is a D-ring or metal loop.

Also disclosed is a garment bag of the type used to carry clothes on hangers. This garment bag has an outer wall made of generally flexible material (such as cloth) which permits the garment bag to be folded at a fold line which is perpendicular to its longitudinal dimension to form a garment bag and any clothes contained therein into a suitcase-like configuration. This garment bag includes a carrying console which comprises a stiffening batten extending perpendicular to the longitudinal dimension of the garment bag and located close to the outer wall of the case at this fold line. A shoulder strap containing system is provided which comprises an elongated closure means through this outer wall of the garment bag and extends perpendicular to the longitudinal dimension of the garment bag close to the fold line. A tensile means, such as a length of the shoulder strap webbing or a separate loop of cloth or webbing, extends from the stiffening batten to approximate the elongated closure means. Means are provided for attaching the shoulder strap to the tensile means and a shoulder strap is attached thereto. Thus, when the shoulder strap is deployed through the closure means, the shoulder strap can be used to support the garment bag.

DETAILED DESCRIPTION OF THE PREFERRED EMBODIMENT

Figure 1:
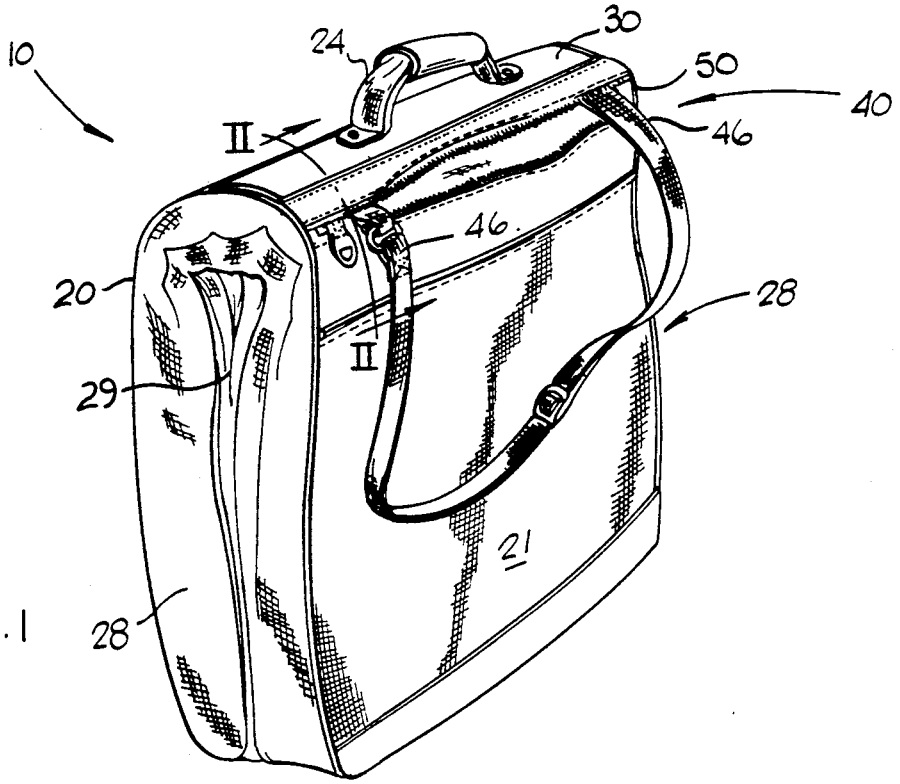
FIG. 1 shows a folded garment bag with a shoulder strap according to the instant invention.

The luggage case 10 is a garment bag which has a main body portion 20 of a known construction, such as that shown in U.S. Pat. No. 4,662,513, which is assigned to the assignee of the subject invention.

The main body is generally defined by an outer wall or panel 21 which extends over the entire length of the garment bag and forms the outwardly facing surface thereof. Side rails 28 extend between this outer panel and an inner panel 29 which has a zippered panel (not shown) through which garments on hangers are normally packed. The outer panel 21 usually has one or more zippered pockets for use by the traveller in packing folded garments and the like.

The handle console 30 is located at the uppermost portion of the bag when folded in a suitcase-like configuration as shown in FIG. 1. A carry handle 24 is riveted via rivets 34 to the top console preferably to a stiffening rod or batten 32.

Unlike conventional garment bags, however, the preferred embodiment includes a shoulder strap pocket 50 positioned to one side of the top console and out of which normally extends a shoulder strap 40 for carrying the garment bag from the shoulder. The strap pocket 50 includes a zippered closure 52 located along the top edge of the strap pocket 50 and extending substantially the entire width of the garment bag from first side rail 28 to the opposite side rail 28 (not shown). The shoulder strap is fastened to the case 10 by a tension means which include a pair of attachments 46 which are at least partially within the shoulder strap pocket 50 and can be deployed out through the zippered closure 52 as shown. These attachments 46 are positioned approximate the opposite ends of the elongated pocket or envelope 50.

Figure 2:
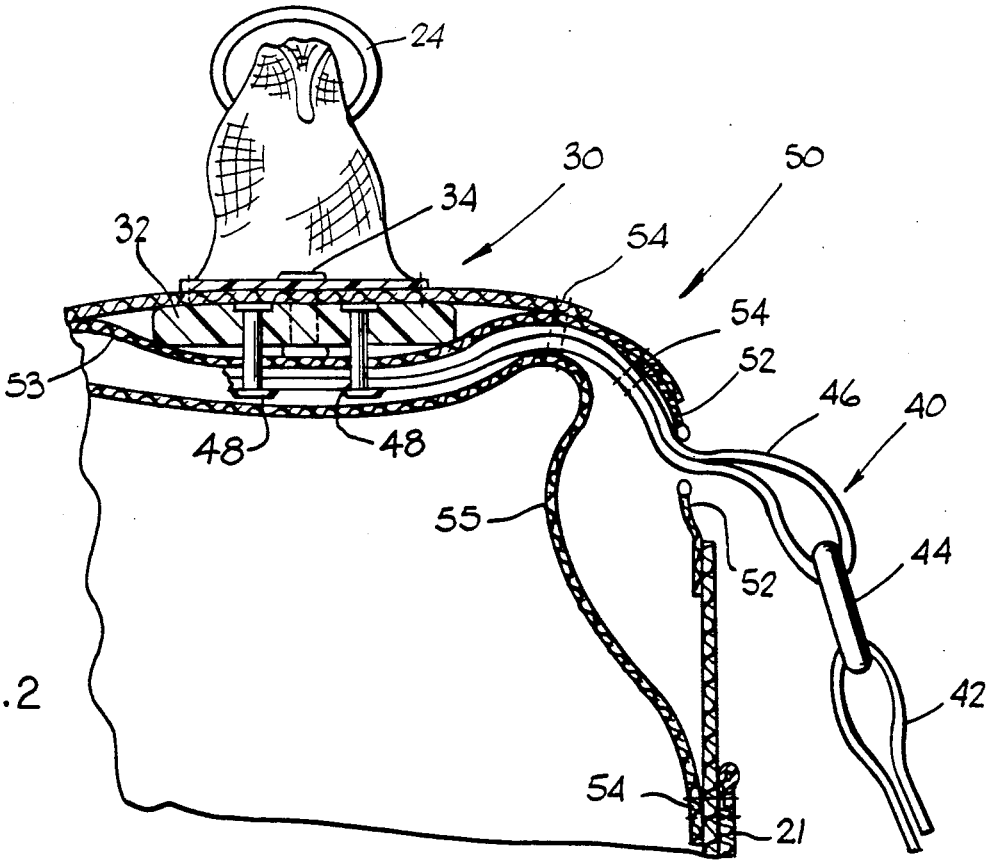
FIG. 2 shows a detail with a portion of the garment bag of FIG. 1 cut away along lines 11—11.

FIG. 2 shows details of the preferred construction. The top console includes a batten 32 which extends the full width of the garment bag for stiffening the top console so that the carrying forces are distributed across the upper console from rail to rail. The batten also gives form and structure to the garment bag when carried in the suitcase-like configuration. This batten may be wood but is preferably an extruded polyvinylchloride profile. Rivets 34 pass through the webbing ends of the handle 24, through the outer cloth covering of the console, and through the batten. Opposite ends of each attachment 46 extend to below the batten and are fastened to the batten via a pair of rivets 48. A backing cloth 55 is stitched into position across the width of the bag below the console. This backing cloth extends laterally to define the inside of the shoulder strap pocket. Stitching 54 holds the various layers (including layer 53) together to define the shoulder strap pocket 50. In like manner, the zipper closure 52 is stitched to opposite sides of the outer cloth portion of the shoulder strap pocket.

One of the attachments 46 is shown to be a length of webbing forming a loop which is attached via D-ring 44 to an adjustable loop of webbing on the shoulder strap itself. The other end of the shoulder strap is attached to the interior of the console 30 by an extension 46 of that end of the shoulder strap webbing.

Thus it can be seen that each of the attachments 46 have an outermost end which extends through a wall of the shoulder strap pocket from beneath the console into the inside of the shoulder strap pocket so that the shoulder strap can be selectively deployed through the zipper closure as will be set forth. In operation then the shoulder strap is withdrawn through the zipper closure 52 and placed over the shoulder of the user. Unlike a conventional luggage case wherein the shoulder strap, if any, is attached to the outer surface of the top console and straddles the carry handle 24, the instant invention provides a shoulder strap which is laterally displaced from the top console. Thus when the user places the strap over the user's shoulder, the bulk of the garment bag or other luggage piece is suspended from the shoulder strap at the user's side in an asymmetric fashion.

When not in use, as for example when the luggage piece must be checked on an airline, the shoulder strap is merely folded up and stuffed into the shoulder strap pocket 50 and the zipper closure 52 operated to secure the shoulder strap in its stored position. Thus the attachments 46 are fully contained within the shoulder strap pocket, along with the attached shoulder strap webbing 42.

The shoulder strap pocket 50 is sized to accommodate a shoulder strap and its attachment portions and little else. Thus the shoulder strap pocket is dedicated to the sole function of either containing or deploying the shoulder strap. The forces involved in carrying any heavily laden garment bag via the shoulder straps is taken by the attachments 46 directly to the body portion 20 of the garment bag, thus bypassing the cloth walls of the shoulder strap pocket. In this way, the stress of carrying the bag with the shoulder strap is distributed to the bag itself via the rivets 48 and into the batten 32 of the top console.

The subject construction has many advantages over the conventional shoulder strap which is normally mounted directly to the top of the top console. In particular, such conventionally mounted shoulder straps require complex attaching and detaching systems, usually comprising a pair of D-rings to which snap hooks located at each end of the shoulder strap are attached. Such D-ring and snap hook construction tends to be inordinately heavy and the aggregation of parts can lead to failure of the shoulder strap under stress. When such a conventionally appointed luggage piece is checked, the shoulder strap must be removed from its operative position by releasing the snap hooks and placing the thus detached shoulder strap in a pocket. Thus the shoulder strap can become lost or at least misplaced since the traveller may not consistently place the shoulder strap in any particular outside pocket. In contrast, the instant invention provides a permanently attached shoulder strap which can only be located when stored in one position, namely the dedicated shoulder strap pocket.

While a garment bag is shown in this preferred embodiment, any luggage case which is provided with a shoulder strap may benefit from the disclosed construction. For example, other pieces of so-called "carry on" luggage, which may comprise a small duffle, a small softsided briefcase or the like, may incorporate a shoulder strap pocket and its permanently attached and easily deployable shoulder strap without departing from the teachings of this invention.

I claim:

1. A hand luggage case having an outer wall and a handle console extending across the case at its uppermost end to which a carry handle is attached, said case further including a shoulder strap for suspending the case from the shoulder of the user for convenient carrying, the improvement comprising, an elongated envelope for containing said shoulder strap attached to said outer wall approximate to said console, said envelope having a first end and a second end, means inside said envelope for attaching said shoulder strap to said case, and a selectively openable closure means extending between said first end and said second end of said envelope, said shoulder strap being normally contained within said envelope and fastened to said case, whereby when said shoulder strap is deployed from said envelope via said closure means, said shoulder strap can be used to support said case.

2. A case as set forth in claim 1 wherein said means for attaching said shoulder strap includes first means located at the first end of said envelope and second means at the second end of said envelope.

3. A case as set forth in claim 1 wherein said means for attaching said shoulder strap comprises tension means for attaching said shoulder strap to said console.

4. A case as set forth in claim 1 wherein said closure means comprises a zipper-type closure which extends along one side of said envelope parallel to said console.

5. A case as set forth in claim 4 wherein said zipper-type closure is on a side of said envelope closest to said console.

6. A case as set forth in claim 1 wherein said envelope comprises a first web of flexible fabric material fastened to a first surface of said outer wall, said web extending approximately the same length of said console and parallel to said console, said console including a batten fastened to a second surface of said outer wall, said envelope and said batten being approximate to one another, a length of fabric material extending from said batten to an inside surface of said envelope, and means for connecting said length to said shoulder strap, whereby when said shoulder strap is deployed through said closure means, said shoulder strap can be used to support said garment bag.

7. A case as set forth in claim 6 wherein said length of fabric extends along an axis perpendicular to the longitudinal axis of said batten and perpendicular to the long dimension of said envelope.

8. A case as set forth in claim 7 wherein said envelope is positioned to one side of said batten, and wherein said envelope is sized to just accommodate said shoulder strap.

9. A garment bag of the type used to carry clothes on hangers having an outer wall made of generally flexible material which permits the garment bag to be folded at a fold line perpendicular to its longitudinal dimension to form the garment bag and any clothes contained therein into a suitcase-like configuration; said garment bag comprising:

a carrying console for the garment bag comprising a stiffening batten which extends perpendicular to the longitudinal dimension of the garment bag and located approximate to the outer wall of the case at the fold line;

a shoulder strap containing system comprising an elongated closure means through the outer wall and extending perpendicular to the longitudinal dimension of the garment bag and approximate to the fold line, said closure means capable of being in an open and a closed configuration;

tension means attached to and extending from said stiffening batten to approximate to said elongated closure means said tension means being normally positioned within said closure means when said closure means is in said closed configuration;

a shoulder strap attached to said tension means, whereby when said shoulder strap is deployed through said closure means when said closure means is in said open configuration, said shoulder strap can be used to support said garment bag.

10. A garment bag comprising a first flexible wall normally positioned to the outside of the garment bag when the garment bag is folded in a suitcase-like configuration along a line generally perpendicular to a longitudinal dimension of said garment bag, a second inside wall having means for inserting garments on hangers into said garment bag, flexible fabric rails attached to said first and second walls, a carrying handle attached to the outside wall of the garment bag, a stiffening batten opposite said carrying handle extending perpendicular to said longitudinal dimension of the garment bag, said batten having first and second ends approximate opposite fabric rails, a tension means permanently fastened to said batten approximate to one end, a second tension means permanently attached to said batten approximate said other end, an elongated opening extending parallel to the length of said batten and positioned to permit access to said first and second tension means through said first flexible wall, a shoulder strap attached at its ends to each of said tension means such that said shoulder strap may be selectively extended through said elongated opening.

11. A garment bag having an overall longitudinal dimension and first and second spaced flexible walls between which garments hanging on hangers are normally suspended for travel, the first and second walls being so constructed to fold across said longitudinal dimension approximately at a middle portion to form a garment bag in a suitcase-like configuration, a batten extending across the width of the garment bag approximately at the middle portion, an elongated envelope attached to one of said walls approximate to said batten, means inside said envelope for attaching a shoulder strap, said means including first means located at one end of said envelope and second means at the other end of said envelope, and a closure means between said one end and said other end for selectively closing said envelope, a shoulder strap normally contained within said envelope and fastened to said bag by said means for attaching, whereby when said closure means is opened and said shoulder strap is released, said shoulder strap can be used to support said garment bag in a suitcase-like configuration.

12. A garment bag as set forth in claim 11 wherein said attachment means comprises tension means for attaching said shoulder strap to said batten.

13. A garment bag as set forth in claim 11 wherein said closure means comprises a slide-type fastener which extends along one side of said envelope parallel to said batten.

14. A garment bag as set forth in claim 13 wherein said slide closure is on the side of said envelope closest to said batten.

15. A garment bag as set forth in claim 11 wherein said envelope comprises a first web of flexible fabric material fastened to a first surface of said first wall, said web extending approximately the same length of said batten and parallel to said batten, said batten being fastened to the second surface of said first wall, said envelope and said batten being approximate to one another, said first means includes a loop of fabric material extending from said batten to an inside surface of said envelope, and means for connecting said loop to said shoulder strap.

16. A garment bag as set forth in claim 15 wherein said fabric loop extends along an axis perpendicular to the longitudinal axis of said batten and perpendicular to the longitudinal axis of said envelope.

17. A garment bag as set forth in claim 16 wherein said envelope is positioned to one side of said batten and perpendicular to the elongated dimension of said garment bag, and wherein said envelope is just large enough to fully enclose a shoulder strap.

* * * * *